US009018859B2

(12) United States Patent
Hu

(10) Patent No.: US 9,018,859 B2
(45) Date of Patent: Apr. 28, 2015

(54) LED BACKLIGHT DRIVING CIRCUIT AND LCD DEVICE

(71) Applicant: Shenzhen China Star Optoelectronics Technology Co., Ltd., Shenzhen (CN)

(72) Inventor: Anle Hu, Shenzhen (CN)

( * ) Notice: Subject to any disclaimer, the term of this patent is extended or adjusted under 35 U.S.C. 154(b) by 203 days.

(21) Appl. No.: 13/884,960

(22) PCT Filed: Apr. 7, 2013

(86) PCT No.: PCT/CN2013/073780

§ 371 (c)(1),
(2) Date: May 11, 2013

(87) PCT Pub. No.: WO2014/153791

PCT Pub. Date: Oct. 2, 2014

(65) Prior Publication Data

US 2014/0292227 A1 Oct. 2, 2014

(51) Int. Cl.

| | |
|---|---|
| ***H05B 37/02*** | (2006.01) |
| ***H05B 33/08*** | (2006.01) |
| ***G09G 3/34*** | (2006.01) |

(52) U.S. Cl.

CPC ..... *H05B 33/0815* (2013.01); *G09G 3/3406* (2013.01)

(58) Field of Classification Search

USPC ..... 315/185 R, 209 R, 219, 291, 307, 308

See application file for complete search history.

(56) References Cited

U.S. PATENT DOCUMENTS

| | | | | |
|---|---|---|---|---|
| 6,987,787 | B1 | 1/2006 | Mick | |
| 7,999,484 | B2 * | 8/2011 | Jurngwirth et al. | 315/247 |
| 8,847,516 | B2 * | 9/2014 | Chobot | 315/307 |
| 2011/0156605 | A1 | 6/2011 | Ku et al. | |

FOREIGN PATENT DOCUMENTS

| | | | |
|---|---|---|---|
| CN | 101888228 | A | 11/2010 |
| CN | 102215616 | A | 10/2011 |
| CN | 102237043 | A | 11/2011 |
| CN | 102542981 | A | 7/2012 |
| CN | 202454225 | U | 9/2012 |
| CN | 202887564 | U | 4/2013 |
| JP | 2006-511078 | A | 3/2006 |

OTHER PUBLICATIONS

Luo Yun, the International Searching Authority written comments, Dec. 2013, CN.

* cited by examiner

*Primary Examiner* — Jimmy Vu

(57) ABSTRACT

A light emitting diode (LED) backlight driving circuit of the present disclosure includes a constant current driver chip, a power module, an LED lightbar coupled to the power module, a dimming module coupled to the LED lightbar, and a low-pass filter. The constant current driver chip comprises a multiplier, and the constant current driver chip generates a gate signal and a dimming signal that are sent to an input end of the multiplier. An output end of the multiplier is coupled to the power module, and is coupled to the dimming module through the low-pass filter.

18 Claims, 3 Drawing Sheets

LED BACKLIGHT DRIVING CIRCUIT AND LCD DEVICE

This application is a national stage Application of PCT application PCT/CN2013/073780 filed on Apr. 7, 2013, which is based on and claims priority to Chinese patent application 201310106859.6 filed on Mar. 29, 2013 in China. The entirety of each of the above-mentioned applications is hereby incorporated by reference herein in its entirety.

TECHNICAL FIELD

The present disclosure relates to the field of a liquid crystal display (LCD), and more particularly to a light emitting diode (LED) backlight driving circuit and an LCD device.

BACKGROUND

A liquid crystal display (LCD) device, such as a liquid crystal (LC) television, includes an LCD panel and a backlight module. The backlight module using a light emitting diode (LED) as a backlight source needs to use an LED backlight driving circuit. A typical LED backlight driving circuit includes a constant current driver chip. As shown in FIG. 1, the constant current driver chip includes two output pins. A first output pin outputs a gate signal adjusting a driving voltage of the LED backlight driving circuit, and a second output pin outputs a pulse-width modulation (PWM) dimming signal adjusting brightness of an LED lightbar. The typical LED backlight driving circuit needs two pins of the constant current driver chip, which increases area and cost of the constant current driver chip.

SUMMARY

In view of the above-described problems, the aim of the present disclosure is to provide a light emitting diode (LED) backlight driving circuit and a liquid crystal display (LCD) device capable of reducing area and cost of a constant current driver chip.

The aim of the present disclosure is achieved by the following method.

An LED backlight driving circuit comprises a constant current driver chip, a power module, an LED lightbar coupled to the power module, a dimming module coupled to the LED lightbar, and a low-pass filter. The constant current driver chip comprises a multiplier.

The constant current driver chip generates a gate signal and a dimming signal that are sent to an input end of the multiplier. An output end of the multiplier is coupled to the power module, and is coupled to the dimming module through the low-pass filter.

In one example, the low-pass filter comprises a first resistor and a first capacitor that are successively connected in series between the output end of the multiplier and a ground end of the LED backlight driving circuit. A control end of the dimming module is coupled between the first resistor and the first capacitor. This is a special circuit structure of the low-pass filter.

In one example, the first capacitor is connected with a voltage-regulator diode in parallel. An anode of the voltage-regulator diode is coupled to the ground end of the LED backlight driving circuit, and a cathode of the voltage-regulator diode is coupled to the control end of the dimming module.

In one example, a capacitance value of the first capacitor is 33 nF and a resistance value of the first resistor R1 is 510Ω. This is a special parameter, which is effective to control the high frequency signal.

In one example, a frequency range of the gate signal is between 100 KHz and 300 KHz. This is a frequency range of the gate signal.

In one example, a frequency range of the dimming signal is between 140 Hz and 240 Hz. This is a frequency range of the dimming signal.

In one example, the power module comprises an inductor, a diode, a first controllable switch, and a second resistor. A first end of the inductor is connected to an external power source, and a second end of the inductor is connected to an anode of the diode. A cathode of the diode is connected to the LED lightbar. The first controllable switch and the second resistor are connected in series, and are connected between the anode of diode and a ground end of the LED backlight driving circuit. The output end of the multiplier is coupled to a control end of the first controllable switch through the low-pass filter.

In one example, the LED backlight driving circuit further comprises a second controllable switch and a third resistor. The second controllable switch and the third resistor are connected in series between an output end of the LED lightbar and the ground end of the LED backlight driving circuit. The multiplier is coupled to a control end of the second controllable switch through the low-pass filter.

In one example, the power module comprises an inductor, a diode, a first controllable switch, and a second resistor. A first end of the inductor is connected to an external power source, and a second end of the inductor is connected to an anode of the diode. A cathode of the diode is connected to the LED lightbar. The first controllable switch and the second resistor are connected in series, and are connected between the anode of diode and a ground end of the LED backlight driving circuit. The power module further comprises a second controllable switch and a third resistor. The second controllable switch and the third resistor are connected in series between an output end of the LED lightbar and the ground end of the LED backlight driving circuit. The low-pass filter comprises a first resistor and a first capacitor that are successively connected in series between the output end of the multiplier and the ground end of the LED backlight driving circuit. A control end of the first controllable switch is coupled to the output end of the multiplier. A control end of the second controllable switch is coupled to the first resistor and the first capacitor. The first capacitor is connected to a voltage-regulator diode in parallel. An anode of the voltage-regulator diode is coupled to the ground end of the LED backlight driving circuit, and a cathode of the voltage-regulator diode is coupled to the control end of the second controllable switch. A capacitance value of the first capacitor is 33 nF and a resistance value of the first resistor R1 is 510Ω. A frequency range of the gate signal is between 100 KHz and 300 KHz. The gate signal is a square-waved signal having a constant duty ratio. The dimming signal is a square-waved signal having a non-constant duty ratio.

An LCD device comprises an LED backlight driving circuit of the present disclosure.

In research, when the dimming signal is at a low level, the gate signal adjusting a voltage is also at a low level. However, when the gate signal is at the low level, the dimming signal may not be at the low level. Thus, the present disclosure uses the multiplier to combine the gate signal and the dimming signal. When the dimming signal is at a high level, the multiplier outputs the gate signal, when the dimming signal is at the low level, the multiplier outputs a constant low level signal, which achieves an adjusting voltage function of the power module. For the dimming module, the dimming signal is at the high level, the multiplier outputs the gate signal. Because the gate signal is a variable square-waved signal having a high frequency, the present disclosure uses the low-pass filter to allow the high frequency part of the signal to slow down and does not change the low frequency part of the signal. Thus, the signal that reaches the dimming module is consistent with the dimming signal, which achieves a dimming function of the dimming module. The constant current driver chip of the present disclosure only needs one output pin to achieve the adjusting voltage and dimming function, and reduces requirement of the constant current driver chip, thereby reducing costs of the constant current driver chip.

BRIEF DESCRIPTION OF FIGURES

As shown in FIG. 2, the present disclosure provides a liquid crystal display (LCD) device comprising a light emitting diode (LED) backlight driving circuit 1. The LED backlight driving circuit 1 comprises a constant current driver chip 10, a power module 20, an LED lightbar 30 coupled to the power module 20, a dimming module 40 coupled to the LED lightbar 30, and a low-pass filter 50. The constant current driver chip 10 comprises a multiplier 11.

Figure 1:
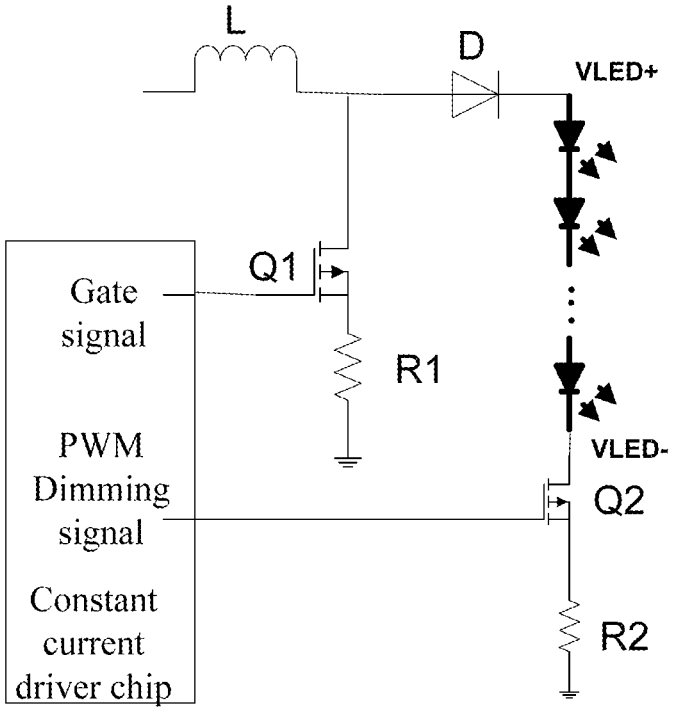
FIG. 1 PRIOR ART
FIG. 1 is a schematic diagram of a light emitting diode (LED) backlight driving circuit of the prior art.

The constant current driver chip 10 generates a gate signal and a dimming signal that are sent to an input end of the multiplier 11. An output end of the multiplier 11 is coupled to the power module 20, and is coupled to the dimming module 40 through the low-pass filter 50.

In research, when the dimming signal is at a low level (logic 0), the gate signal adjusting a voltage is also at a low level. However, when the gate signal is at the low level, the dimming signal may not be at the low level. Thus, the present disclosure uses the multiplier 11 to combine the gate signal and the dimming signal. When the dimming signal is at a high level (logic 1), the multiplier 11 outputs the gate signal, when the dimming signal is at the low level, the multiplier 11 outputs a constant low level signal, which achieves an adjusting voltage function of the power module 20. For the dimming module 40, the dimming signal is at the high level, the multiplier 11 outputs the gate signal. Because the gate signal is a variable square-waved signal having a high frequency, the present disclosure uses the low-pass filter 50 to allow the high frequency part of the signal to slow down and does not change the low frequency part, of the signal. Thus, the signal that reaches the dimming module 40 is consistent with the dimming signal, which achieves a dimming function of the dimming module 40. The constant current driver chip 10 of the present disclosure only needs one output pin to achieve the adjusting, voltage and dimming function, and reduces requirements of the constant current driver chip 10, thereby reducing costs of the constant current driver chip 10.

The present disclosure will further be described in detail in accordance with the figures and the exemplary examples.

Figure 2:
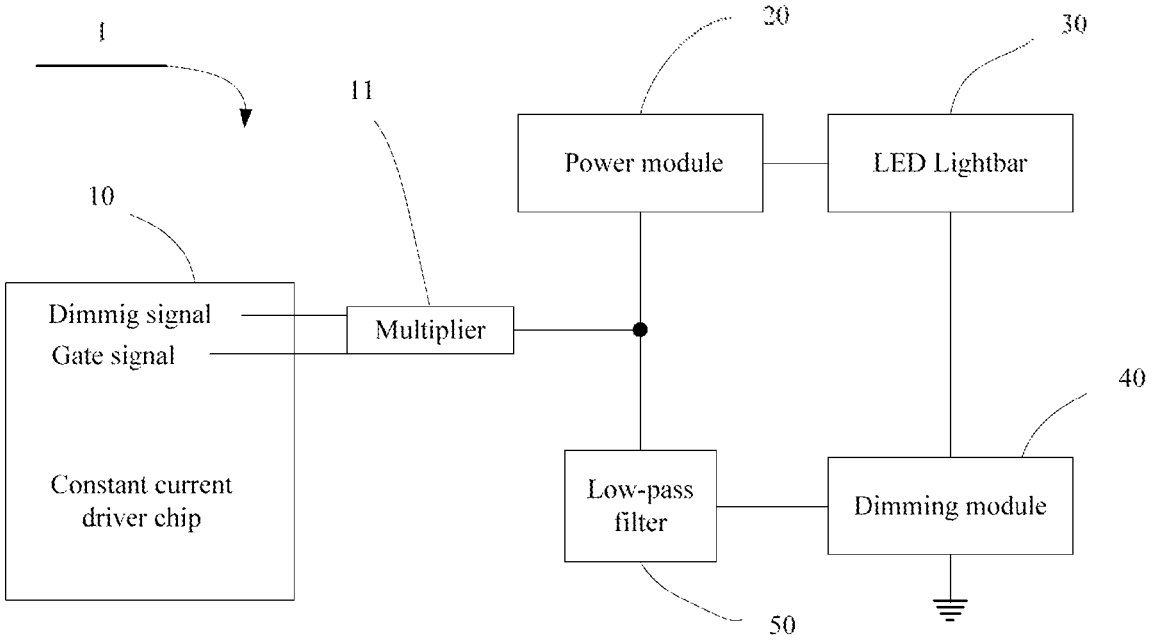
FIG. 2 is a schematic diagram of a light emitting diode (LED) backlight driving circuit of the present disclosure.
Figure 3:
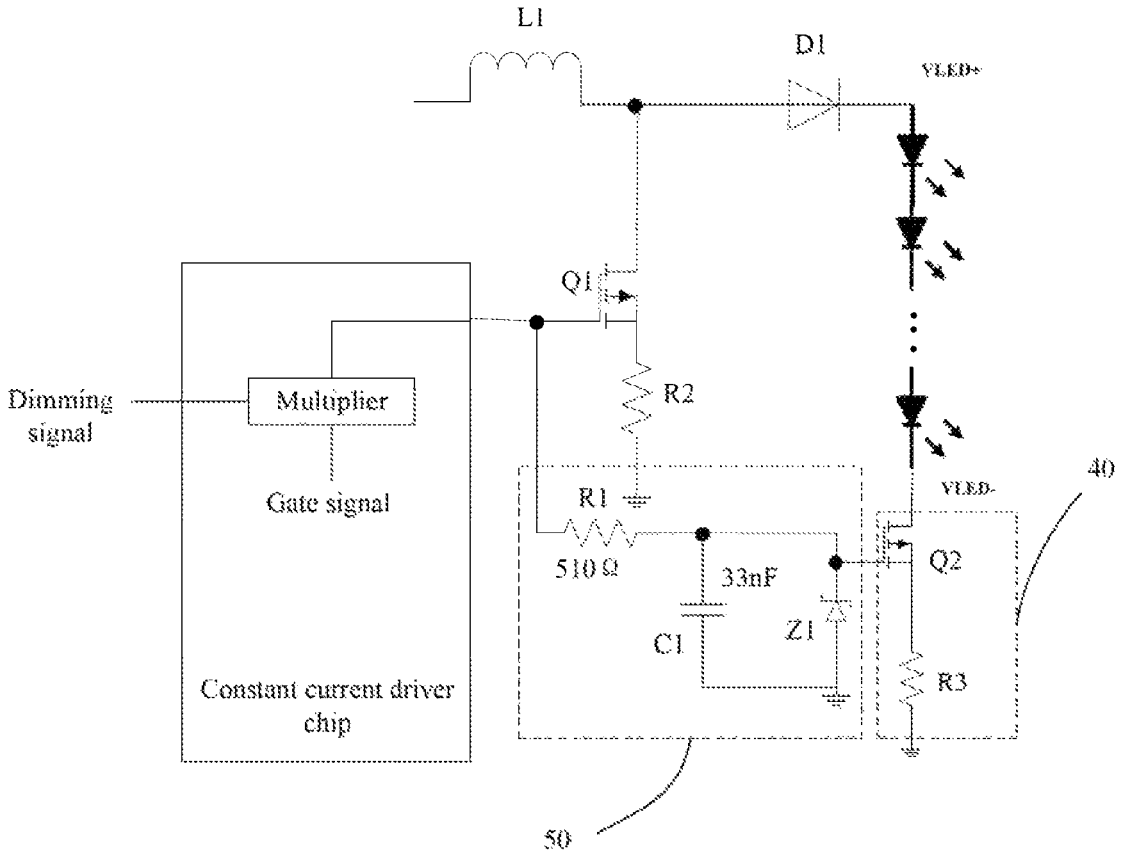
FIG. 3 is a schematic diagram of a light emitting diode (LED) backlight driving circuit of an example of the present disclosure.
Figure 4:
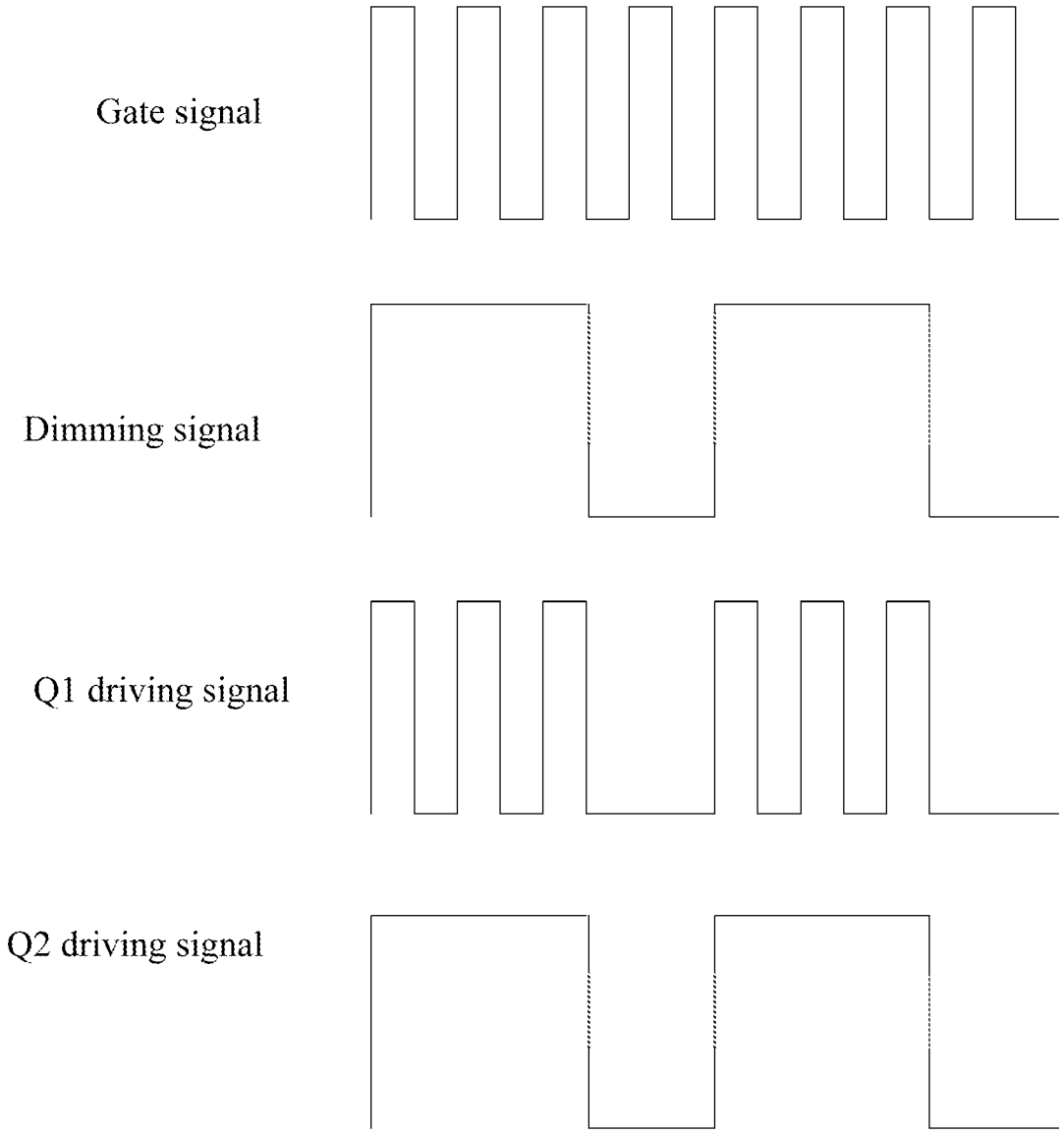
FIG. 4 is a schematic diagram of a driving waveform of an LED backlight driving circuit of an example of the present disclosure.

As shown in FIG. 2-FIG. 4, an LED backlight driving circuit 1 comprises a constant current driver chip 10, a power module 20, an LED lightbar 30 coupled to the power module 20, a dimming module 40 coupled to the LED lightbar 30, and a low-pass filter 50. The constant current driver chip 10 comprises a multiplier 11. The constant current driver chip 10 generates a gate signal and a dimming signal that are sent to an input end of the multiplier 11. An output end of the multiplier 11 is coupled to the power module 20, and is also coupled to the dimming module 40 through the low-pass filter 50.

The gate signal may be a square-waved signal having, a constant duty ratio. The dimming signal may be a square-waved signal having a non-constant duty ratio. Thus, the gate signal is constant, and adjusting voltage and dimming light are simultaneously achieved by only adjusting the dimming signal, which simplifies a control method of the LED backlight driving circuit, reduces design difficult, shortens development time, simplifies circuit structure of the constant current driver chip 10, and reduces device costs.

The power module 20 comprises an inductor L1, a diode D1, a first controllable switch Q1, and a second resistor R2. A first end of the inductor L1 is connected to an external power source, and a second end of the inductor L1 is connected to an anode of the diode D1. A cathode of the diode D1 is connected to the LED lightbar. The first controllable switch Q1 and the second resistor R2 are connected in series, and are connected between the anode of diode D1 and a ground end of the LED backlight driving circuit 1. The power module 20 further comprises a second controllable switch Q2 and a third resistor R3. The second controllable switch Q2 and the third resistor R3 are connected in series between an output end of the LED lightbar 30 and the ground end of the LED backlight driving circuit.

The low-pass filter 50 comprises a first resistor R1 and a first capacitor C1 that are successively connected in series between the output end of the multiplier 11 and the ground end of the LED backlight driving circuit 1. A control end of the first controllable switch Q1 is coupled to the output end of the multiplier 11, and a control end of the second controllable switch Q2 is coupled between the first resistor R1 and the first capacitor C1. The first capacitor C1 is connected with a voltage-regulator diode Z1 in parallel. An anode of the voltage-regulator diode Z1 is coupled to the ground end of the LED backlight driving circuit 1, and a cathode of the voltage-regulator diode Z1 is coupled to the control end of the second controllable switch Q2. A capacitance value of the first capacitor C1 is 33 nF and a resistance value of the first resistor R1 is 510Ω in an example of the present disclosure. The capacitance value of the first capacitor C1 and the resistance value of the first resistor R1 may be adjusted properly according to different circuit structures.

In the constant current driver chip 10, the dimming signal is usually a pulse-width modulation (PWM) signal, where a frequency range of the dimming signal is about between 140 Hz and 240 Hz. A frequency range of the gate signal usually is between 100 KHz and 300 KHz. The dimming signal and the gate signal are combined by the multiplier 11 to form an output signal output by one output pin of the constant current driver chip 10, and then the output signal passes through the low-pass filter 50 comprising the first resistor R1 (510Ω) and the first capacitor C1 (33 nF) to be formed a driving signal of the second controllable switch Q2 of the dimming module 40 to control the LED lightbar. The low-pass filter 50 comprising the first resistor R1 and the first capacitor C1 allows a high frequency part of the signal to slow down and does not change a low frequency part of the signal. Thus, a waveform of the driving signal that reaches the second controllable switch Q2 is consistent with the dimming signal (as shown in FIG. 4).

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A light emitting diode (LED) backlight driving circuit, comprising:

a constant current driver chip;

a power module;

an LED lightbar coupled to the power module;

a dimming module coupled to the LED lightbar; and a low-pass filter;

wherein the constant current driver chip comprises a multiplier, and the constant current driver chip generates a gate signal and a dimming signal that are sent to an input end of the multiplier, an output end of the multiplier is coupled to the power module, and is coupled to the dimming module through the low-pass filter.

2. The LED backlight driving circuit of claim 1, wherein the low-pass filter comprises a first resistor and a first capacitor that are successively connected in series between the output end of the multiplier and a ground end of the LED backlight driving circuit, and a control end of the dimming module is coupled between the first resistor and the first capacitor.

3. The LED backlight driving circuit of claim 2, wherein the first capacitor is connected with a voltage-regulator diode in parallel, an anode of the voltage-regulator diode is coupled to the ground end of the LED backlight driving circuit, and a cathode of the voltage-regulator diode is coupled to the control end of the dimming module.

4. The LED backlight driving circuit of claim 2, wherein a capacitance value of the first capacitor is 33 nF and a resistance value of the first resistor R1 is 510Ω.

5. The LED backlight driving circuit of claim 1, wherein a frequency range of the gate signal is between 100 KHz and 300 KHz.

6. The LED backlight driving circuit of claim 1, wherein a frequency range of the dimming signal is between 140 Hz and 240 Hz.

7. The LED backlight driving circuit of claim 1, wherein the power module comprises an inductor, a diode, a first controllable switch, and a second resistor; a first end of the inductor is connected to an external power source, and a second end of the inductor is connected to an anode of the diode, a cathode of the diode is connected to the LED lightbar;

wherein the first controllable switch and the second resistor are connected in series, and are connected between the anode of diode and a ground end of the LED backlight driving circuit, the output end of the multiplier is coupled to a control end of the controllable switch.

8. The LED backlight driving circuit of claim 1, further comprising a second controllable switch and a third resistor, the second controllable switch and the third resistor are connected in series between an output end of the LED lightbar and a ground end of the LED backlight driving circuit; the multiplier is coupled to a control end of the second controllable switch through the low-pass filter.

9. The LED backlight driving circuit of claim 1, wherein the power module comprises an inductor, a diode, a first controllable switch, a second resistor, a second controllable switch, and a third resistor; a first end of the inductor is connected to an external power source, and a second end of the inductor is connected to an anode of the diode, a cathode of the diode is connected to the LED lightbar;

wherein the first controllable switch and the second resistor are connected in series, and are connected between the anode of diode and a ground end of the LED backlight driving circuit;

wherein the second controllable switch and the third resistor are connected in series between an output end of the LED lightbar and the ground end of the LED backlight driving circuit;

wherein the low-pass filter comprises a first resistor and a first capacitor that are successively connected in series between the output end of the multiplier and the ground end of the LED backlight driving circuit; a control end of the first controllable switch is coupled to the output end of the multiplier, and a control end of the second controllable switch is coupled to the first resistor and the first capacitor;

wherein the first capacitor is connected to a voltage-regulator diode in parallel; an anode of the voltage-regulator diode is coupled to the ground end of the LED backlight driving circuit, and a cathode of the voltage-regulator diode is coupled to the control end of the second controllable switch; a capacitance value of the first capacitor is 33 nF and a resistance value of the first resistor R1 is 510Ω;

wherein a frequency range of the gate signal is between 100 KHz and 300 KHz; the gate signal is a square-waved signal having a constant duty ratio, the dimming signal is a square-waved signal having a non-constant duty ratio.

10. A liquid crystal display (LCD) device, comprising:

a light emitting diode (LED) backlight driving circuit;

wherein the LED backlight driving circuit comprises a constant current driver chip, a power module, an LED lightbar coupled to the power module, a dimming module coupled to the LED lightbar, and a low-pass filter;

wherein the constant current driver chip comprises a multiplier, and the constant current driver chip generates a gate signal and a dimming signal that are sent to an input end of the multiplier, an output end of the multiplier is coupled to the power module, and is coupled to the dimming module through the low-pass filter.

11. The LCD device of claim 10, wherein the low-pass filter comprises a first resistor and a first capacitor that are successively connected in series between the output end of the multiplier and a ground end of the LED backlight driving circuit, and a control end of the dimming module is coupled between the first resistor and the first capacitor.

12. The LCD device of claim 11, wherein the first capacitor is connected with a voltage-regulator diode in parallel; an anode of the voltage-regulator diode is coupled to the ground end of the LED backlight driving circuit, and a cathode of the voltage-regulator diode is coupled to the control end of the dimming module.

13. The LCD device of claim 11, wherein a capacitance value of the first capacitor is 33 nF and a resistance value of the first resistor R1 is 510Ω.

14. The LCD device of claim 10, wherein a frequency range of the gate signal is between 100 KHz and 300 KHz.

15. The LCD device of claim 10, wherein a frequency range of the dimming signal is between 140 Hz and 240 Hz.

16. The LCD device of claim 10, wherein the power module comprises an inductor, a diode, a first controllable switch, and a second resistor; a first end of the inductor is connected to an external power source, and a second end of the inductor is connected to an anode of the diode, a cathode of the diode is connected to the LED lightbar;

wherein the first controllable switch and the second resistor are connected in series, and are connected between the anode of diode and a ground end of the LED backlight driving circuit, the output end of the multiplier is coupled to a control end of the controllable switch.

17. The LCD device of claim 10, further comprising a second controllable switch and a third resistor, the second controllable switch and the third resistor are connected in series between an output end of the LED lightbar and a ground end of the LED backlight driving circuit; the multiplier is coupled to a control end of the second controllable switch through the low-pass filter.

18. The LCD device of claim 10, wherein the power module comprises an inductor, a diode, a first controllable switch, a second resistor, a second controllable switch, and a third resistor, a first end of the inductor is connected to an external power source, and a second end of the inductor is connected to an anode of the diode, a cathode of the diode is connected to the LED lightbar;

wherein the first controllable switch and the second resistor are connected in series, and are connected between the anode of diode and a ground end of the LED backlight driving circuit;

wherein the second controllable switch and the third resistor are connected in series between an output end of the LED lightbar and the ground end of the LED backlight driving circuit;

wherein the low-pass filter comprises a first resistor and a first capacitor that are successively connected in series between the output end of the multiplier and the ground end of the LED backlight driving circuit; a control end of the first controllable switch is coupled to the output end of the multiplier, and a control end of the second controllable switch is coupled to the first resistor and the first capacitor;

wherein the first capacitor is connected to a voltage-regulator diode in parallel; an anode of the voltage-regulator diode is coupled to the ground end of the LED backlight driving circuit, and a cathode of the voltage-regulator diode is coupled to the control end of the second controllable switch; a capacitance value of the first capacitor is 33 nF and a resistance value of the first resistor R1 is 510Ω;

wherein a frequency range of the gate signal is between 100 KHz and 300 KHz; the gate signal is a square-waved signal having a constant duty ratio; the dimming signal is a square-waved signal having a non-constant duty ratio.

* * * * *